US005121861A

United States Patent [19]

Wong

[11] Patent Number: 5,121,861

[45] Date of Patent: Jun. 16, 1992

[54] BOOT JACK

[76] Inventor: William P. W. Wong, 3030 Montrose Ave., #212, La Crescenta, Calif. 91214

[21] Appl. No.: 691,356

[22] Filed: Apr. 25, 1991

[51] Int. Cl.[5] ..... A47G 25/80

[52] U.S. Cl. ..... 223/114; 223/117; 223/113; 223/111

[58] Field of Search ..... 223/113, 114, 117, 111, 223/115, 116, 120, 641, 642

[56] References Cited

U.S. PATENT DOCUMENTS

| | | | |
|---|---|---|---|
| 175.076 | 3/1876 | Green | 223/117 X |
| 206,523 | 7/1878 | Bartine | 223/117 X |
| 1,636,010 | 7/1927 | Moland | 223/117 |
| 2,525,174 | 10/1950 | Johnstone | 223/114 |
| 2,725,167 | 11/1955 | Barnes | 223/113 |

FOREIGN PATENT DOCUMENTS

| | | | |
|---|---|---|---|
| 47533 | 4/1911 | Austria . | |
| 634050 | 6/1936 | Fed. Rep. of Germany | 223/114 |
| 1332104 | 6/1962 | France | 223/117 |
| 2031264 | 4/1980 | United Kingdom | 223/113 |
| 2144969 | 3/1985 | United Kingdom | 223/114 |

*Primary Examiner*—Werner H. Schroeder
*Assistant Examiner*—Bibhu Mohanty
*Attorney, Agent, or Firm*—Harold L. Jackson

[57] ABSTRACT

A boot jack is described which provides a step tread surface on the top thereof having a generally V-shaped opening arranged about a longitudinal axis for receiving the heel of a boot to be removed from one leg of the user. The opening is formed by a pair of downwardly extending surfaces which terminate in opposed boot heel engaging edges. Left and right foot rest areas are defined by the step tread surface for accommodating the heel and ball of the foot of the other leg. The foot rest areas are symmetrically arranged about the longitudinal axis with a line bisecting each area extending at an acute angle to the longitudinal axis. The boot heel engaging edges are positioned below the step tread surface a sufficient distance to require the knee of the other leg to be bent when the boot to be removed is within the boot heel opening so that primarily the larger muscles of the other leg may be used to remove the boot.

24 Claims, 2 Drawing Sheets

BOOT JACK

1. FIELD OF THE INVENTION

This invention relates to devices for enabling a user to lift a boot or similar footwear off of one foot while holding the device in a stationary position with the other foot.

2. DESCRIPTION OF THE PRIOR ART

Boots which cover all or part of a person's leg (below the knee) and particularly form fitting riding boots, are generally difficult to remove. The wearer may sit down on a chair or bench and enlist the help of a friend to grasp the boot heel while the user's other leg is used to push the friend and the boot away from the user. The user may also place one leg over the other knee and grasp the boot with both hands while bending over. In either case, the task often proves to be difficult, at best.

Mechanical devices commonly referred to as boot jacks or boot lifters simplify the above procedure somewhat by allowing the user to stand during the boot removal process. Prior art boot jacks such as those disclosed in U.S. Pat. Nos. 2,525,174, 4,760,942, 145,172, 169,407, Des. 238,454, French patent 1,332,104 and German patent 47,533 are in the form of an inclined plate or block (made of wood or metal) having an opening at the front or upper end for engaging the heel of the boot to be removed from one foot and a flat surface at the back end for receiving the toe area of the user's other foot. German patent no. 634,050 illustrates a similar type of boot jack in which the plate having an opening for receiving the boot heel is mounted on four legs so that it is parallel to the floor.

To remove the boot the user, while in a standing position, plants the toe area of one of his or her feet on the back or lower end of the plate and then positions the heel of the boot to be removed within the opening so that the sides or lower edges thereof grip the boot heel. The leg on which the boot is to be removed is then lifted until the boot is free. This action while seemingly less difficult than removing a boot by hand utilizes the weaker and lesser used muscles of both legs with the result that such muscles (and sometime their attaching ligaments) are frequently strained. The larger leg muscles (of the leg on which the boot is to be removed) are much better adapted for pushing rather than pulling. Also the muscles in the lower portion of the leg which control the pivoting action of the toe relative to the heel (of the foot anchoring the boot jack) are much smaller and therefore weaker than the upper leg muscles which control knee bending movements.

There is a need for a boot jack or boot lifter which allows a user to efficiently remove his or her boots without help by utilizing the larger and stronger leg muscles thereby minimizing the risk of strained muscles and/or ligaments.

SUMMARY OF THE INVENTION

A boot jack in accordance with my invention includes a step tread surface having an opening symmetrically arranged about a longitudinal axis for receiving the heel portion of a boot to be removed from one leg of the user. The opening is formed by a pair of downwardly extending surfaces which terminate in a pair of opposed boot heel engaging edges. The step tread surface defines left and right foot rest areas for accommodating the heel and ball of the foot of the other leg of the user. The foot rest areas are also symmetrically arranged about the longitudinal axis with a line bisecting each area extending at an acute angle to that axis. The boot heel engaging edges extend below the step tread surface a sufficient distance to require the knee of the other leg to be bent when the heel of the boot to be removed is in position against the boot heel engaging edges.

A support e.g., in the form of a base member, elevates the step tread surface and the boot heel engaging edges above a level surface such as a floor a sufficient distance to accommodate the heel of a boot between the boot heel engaging edges and the level surface.

The features of the present invention can be best understood by reference to the following description taken in conjunction with the accompanying drawings wherein like numerals indicate like components.

DESCRIPTION OF THE PREFERRED EMBODIMENT

Figure 1:
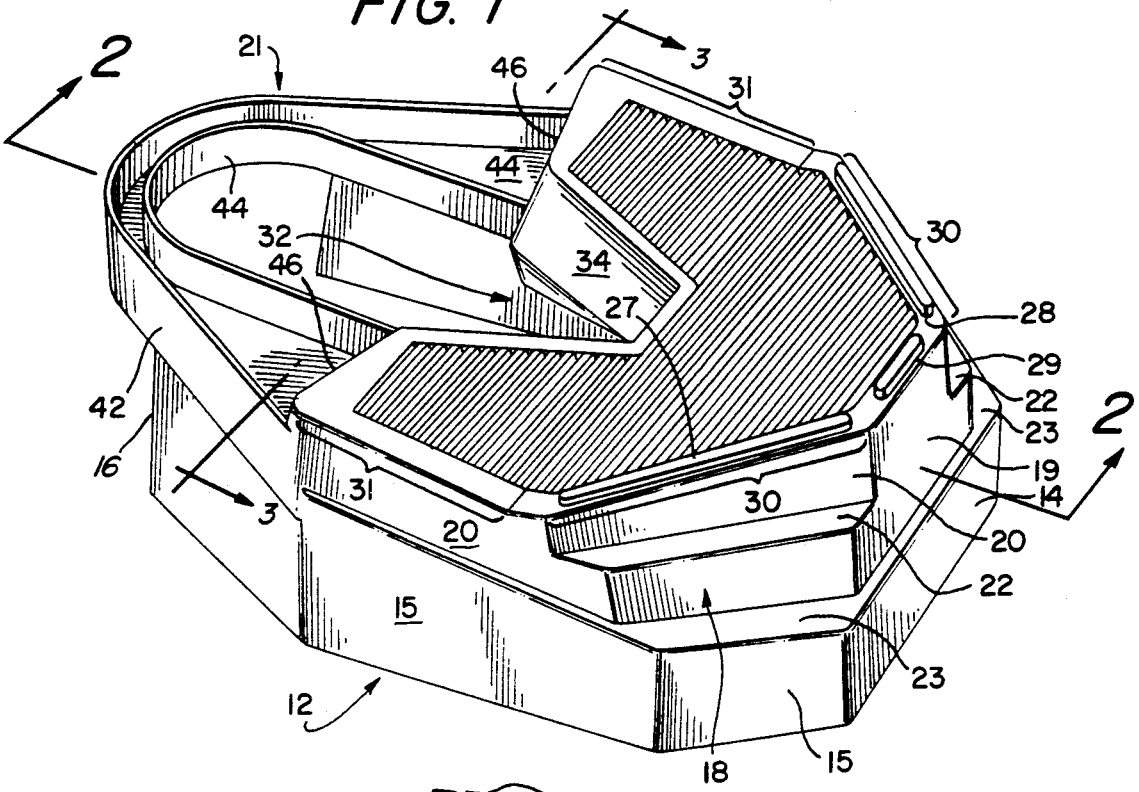
FIG. 1 is a perspective view of a boot jack in accordance with my invention.

Referring now to the drawings, the boot jack includes a base section 12 having a rear end wall 14 and side walls 15 terminating at the front end 16. An upper section 18 formed integrally with the base includes a rear wall 19, side walls 20 and a curved open channel section 21. Horizontal sections 22 and 23 join the walls 20 and 15 as shown to provide a larger base area than the step tread surface area for stability. The upper section provides a ribbed step tread surface (indicated generally at 24) which defines left and right overlapping foot rest areas 25 and 26 for accommodating the heel and ball of the foot of one of the user's legs as is best illustrated in FIG. 4.

The foot rest areas 25 and 26 are symmetrically arranged about a longitudinal axis x—x of the step tread surface and a line bisecting each area intersects a vertical plane passing through the longitudinal axis at an acute angle $\alpha$ within the range of about 30° to 80° and preferably 50°.

Figure 4:
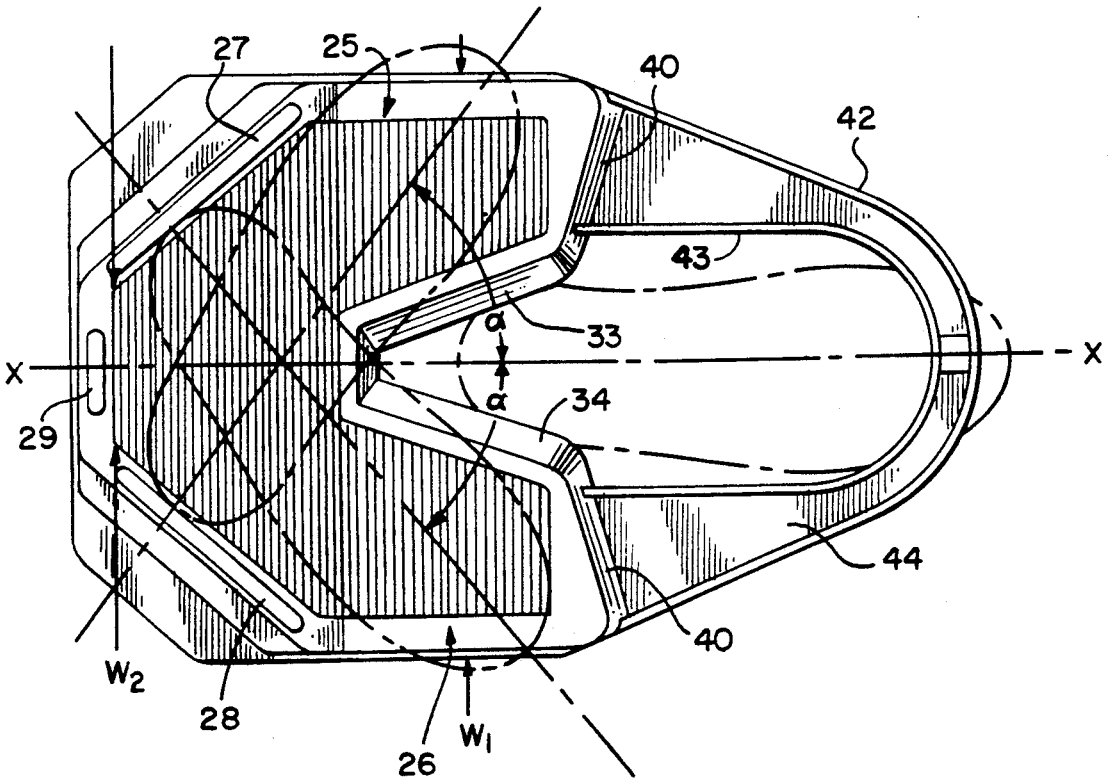
FIG. 4 is a plan view of the boot jack depicting a typical position for the user's feet.
Figure 5:
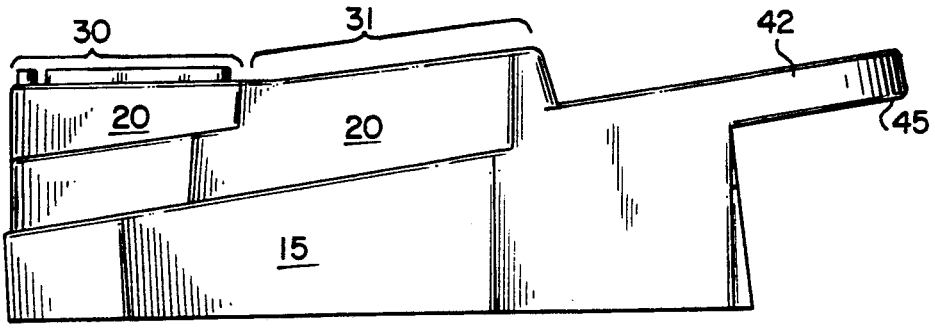
FIG. 5 is a side elevational view of the boot jack.

Ribs 27 and 28 extend upwardly from the step tread surface at the heel accommodating ends of the foot rest areas 25 and 26 as shown in FIGS. 1 and 4. The ribs 27 and 28 provide a convenient backstop for the heels of the user's feet. A short rear rib 29 extends above the rear wall 19 of the upper section 18.

Figure 2:
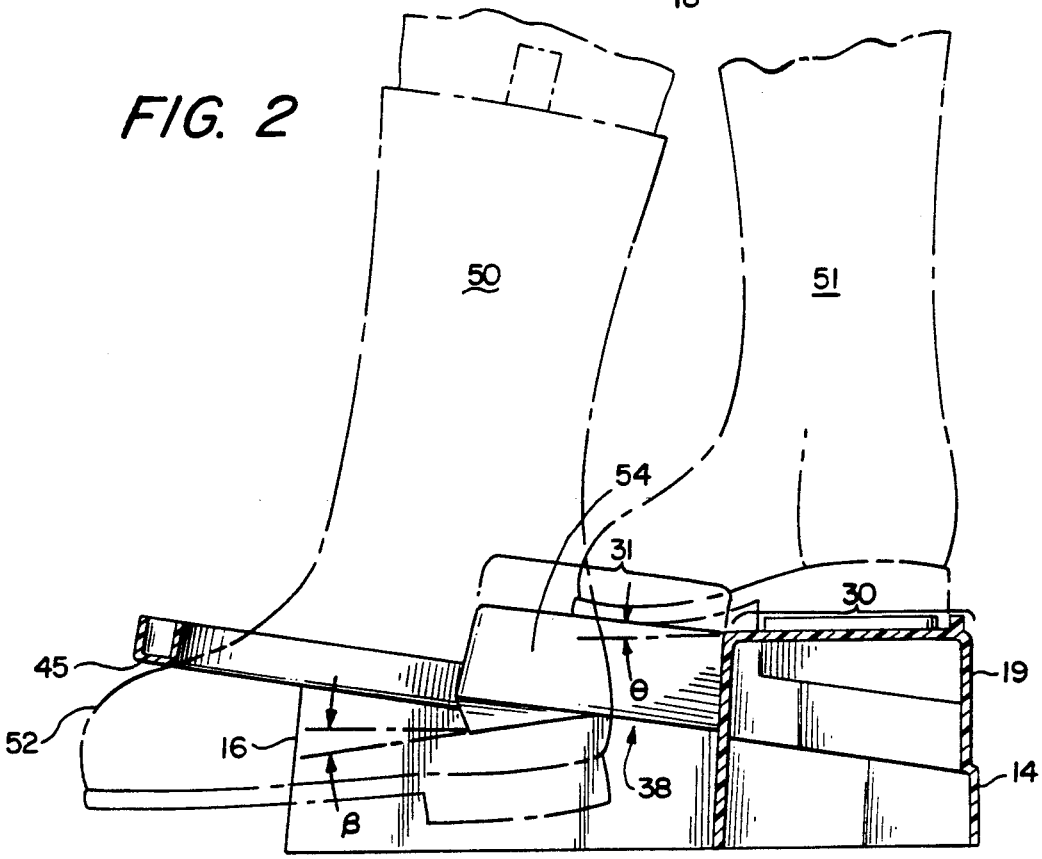
FIG. 2 is a cross-sectional view of the boot jack of FIG. 1 taken along lines 2—2 showing the typical position of a boot ready for removal.

The foot rest areas 25 and 26 are formed in two sections, a heel accommodating section 30 and a ball of the foot accommodating section 31. The sections are arranged in planes which intersect at an acute angle $\theta$ within the range of about 5° to 15° and preferably about 9°. See FIG. 2. The heel accommodating section is preferably parallel with the level surface on which the boot jack rests while the ball of the foot accommodating section is inclined upwardly as illustrated in FIG. 2.

This arrangement allows the user to place a large portion of his or her weight on the heel of the foot that is holding the step jack in place during use as will be more fully explained. The width $W_1$ (FIG. 4) of the ball of the foot accommodating section is within the range of about 8 to 12 inches and preferably about 10.5 inches. The width $W_2$ of the heel accommodating section adjacent the rear wall 19 is within the range of about 3 to 5 inches and preferably about 5 inches. The length of the heel and ball of the foot accommodating areas is about 4.5 to 4 inches, respectively.

A V-shaped opening 32 separates the foot rest areas for receiving the heel of the boot to be removed. The boot heel opening is formed by a pair of opposed downwardly extending surfaces 33 and 34 which terminate in boot heel engaging edges 36 and 38. The opening 32, like the step tread surface, is symmetrically arranged about the longitudinal axis. The boot heel engaging edges 36 and 38 which extend below the step tread surface about 2 inches are also formed in two sections, a proximal section 37, terminating in an end wall 40 at the vertex of the opening and a distal section 39, extending outwardly and downwardly of the proximal section 37 The distal sections of the boot heel engaging edges lie in a plane which extends downwardly from the proximal sections and intersects the level surface on which the base rests at an angle $\beta$ within the range of about 0° to 7° and preferably at about 5° as is illustrated in FIG. 2.

As is illustrated, the ball of the foot accommodating section 31 extends forwardly from the vertex or end wall 40 of the V-shaped opening 32.

The channel section 21 (sometimes referred to as a boot toe engaging member) is formed by a pair of upstanding curved walls 42,43 and a bottom wall 44 which join a pair of front end walls 46 extending downwardly from the step tread surface. The lower surface 45 of the channel section 21 is in a plane (preferably parallel to the section 31) which intersects the level surface at an angle in the same range as $\theta$. This arrangement positions the toe of the boot to be removed at or above the heel so that the user is in a comfortable position while standing on the boot jack. The lower surface 45 at the front of the toe engaging member forms a boot toe engaging surface for restraining the toe of the boot to be removed. The channel section 21 and the side wall surfaces 32 and 34 circumscribe an elliptically shaped opening through which the toe and heel of the boot to be removed is placed as is best illustrated in FIG. 2.

Figure 3:
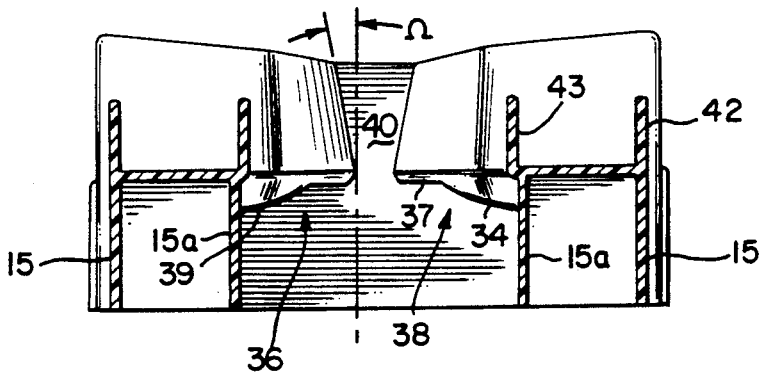
FIG. 3 is a front elevational view taken along lines 3—3 of FIG. 1 showing the surfaces forming the opening to receive the heel of the boot to be removed.

Referring now to FIG. 3, the downwardly extending surfaces 32 and 34 (which terminate in the boot heel engaging edges) form an angle $\Omega$ with a vertical plane passing through the longitudinal axis which is within the range of about 10° to 20° and preferably about 15°. Internal walls 15*a* which form part of the base are also illustrated in FIG. 3. This negative angle $\Omega$ causes the heel engaging edges to increase the grip on the heel of the boot (to be removed) as the user increases the pulling force on the boot. This action prevents the boot from slipping out of the heel engaging portion of the boot jack.

In operation the user places the boot 50 (FIG. 2) to be removed within the opening 32 so that the toe 52 and heel 54 of the boot are restrained from upward movement by the toe engaging surface 44 and the distal section 39 of the boot heel engaging edges, respectively. The foot 51 of the other or active leg is then placed on the step tread surface 22. Since the boot to be removed (on the inactive leg) is lower than the foot resting on the step tread surface the knee of the active leg must be bent. To remove the boot the user simply straightens the knee of the active leg, thereby using the large muscles of that leg to lift the foot out of the captured boot.

There has thus been described a new and efficient boot jack which enables a user to quickly remove a boot while minimizing the risk of muscle or ligament strain. Various modifications of my novel boot jack will be apparent to those skilled in the art without involving any departure from the spirit and scope of my invention as defined in the appended claims.

I claim:

1. A boot jack comprising:

a step tread surface having a generally V-shaped opening therein symmetrically arranged about a longitudinal axis for receiving the heel portion of a boot which is to be removed from one leg of a user, the step tread surface defining left and right foot rests areas for accommodating the heel and ball of the foot of the other leg of the user, the foot rest areas being symmetrically arranged about a longitudinal axis of the step tread surface with each surface extending at a first acute angle thereto;

boot heel engaging means for holding the heel of the boot to be removed a sufficient distance below the step tread surface to require the knee of said other leg to be bent so that the action of straightening said other leg will remove the boot from the heel of said one leg; and support means for elevating the step tread surface and the boot heel engaging means above a level surface a sufficient distance to accommodate the heel of a boot between the boot heel engaging means and said level surface.

2. The boot jack of claim 1 further including a boot toe engaging surface positioned forwardly of and above the boot heel engaging edges when the boot jack is resting on a level surface for restraining the boot toe from upward movement.

3. The boot jack of claim 1 wherein the step tread surface is a composite surface with the heel accommodating areas lying in a first plane substantially parallel to said level surface when the boot jack is in use and the ball of the feet accommodating areas lying in a second plane which joins the first plane at a second acute angle and extends upwardly therefrom so that the ball of the foot resting on the step tread is positioned above the heel thereof.

4. The boot jack of claim 3 wherein the first acute angle is within the range of about 30° to 80°.

5. The boot jack of claim 4 wherein the first angle is about 50°.

6. The boot jack of claim 4 wherein the second acute angle is within the range of about 5° to 15°.

7. The boot jack of claim 6 wherein the second angle is about 9°.

8. The boot jack of claim 6 wherein the boot heel engaging means comprises a pair of boot heel engaging edges extending below the step tread surface and wherein each of the boot heel engaging edges includes a proximal section terminating adjacent the vertex of said opening and a distal section extending outwardly from the proximal section toward the boot toe engaging surface, the distal sections of the boot heel engaging edges lying in a third plane which intersects the level surface at a third angle within the range of about 0° to 7° when the boot jack is in use.

9. The boot jack of claim 8 wherein the plane of the distal section of the boot heel engaging surfaces intersects the level surface at about 50°.

10. The boot jack of claim 8 wherein the surfaces forming the generally V-shaped opening extend downwardly and inwardly toward each other at a fourth angle within the range of about 10° to 20°.

11. The boot jack of claim 10 wherein the fourth angle is about 15°.

12. The boot jack of claim 6 further including a rib extending upwardly from the step tread surface adjacent the edge of each foot rest area to aid in preventing the heel of the user's foot from sliding off of the step tread area when the boot jack is in use.

13. The boot jack of claim 10 wherein the step tread surface comprises a roughened surface to prevent the user's foot from sliding off of the boot jack during use.

14. The boot jack of claim 13 wherein the step tread surface includes ridges running generally perpendicular to the longitudinal axis.

15. The boot jack of claim 3 wherein the width of the ball of the foot accommodating areas of the step tread surface is within the range of about eight to twelve inches.

16. The boot jack of claim 15 wherein the width of the heel accommodating areas of the step tread surface remote from the V-shaped opening is within the range of about three to five inches.

17. A boot jack for enabling a user to remove a boot from an inactive leg by straightening the other or active leg after the boot has been secured in the boot jack comprising:

a base constructed and arranged to rest on a level surface and having front and rear portions;

an upper section carried by the base and having a longitudinal axis, the upper section defining left and right foot rest areas for accommodating the heel and ball of the foot of the user's to be used in removing a boot from the inactive leg, the foot rest areas being symmetrically arranged about the longitudinal axis so that a line drawn from the heel to the ball of the foot of each area intersects a vertical plane passing through the longitudinal axis at a first acute angle with the left foot rest area extending outwardly and to the left of the rear portion and the right foot rest area extending outwardly and to the right of the rear portion;

the upper section having a boot heel opening therein symmetrically arranged about the longitudinal axis for receiving the heel of a boot on the user's inactive leg, the boot heel opening having a vertex and being formed by a pair of generally downwardly extending surfaces terminating in a pair of opposed boot heel engaging edges, each of the foot rest areas comprising a heel and a ball of the foot accommodating section, the ball of the foot accommodating sections extending forwardly of the vertex of the V-shaped opening; and the boot heel engaging edges extending above said level surface a sufficient distance to accommodate the heel of the boot to be removed and extending below the foot rest areas at least about two inches so that the knee of the active leg must be bent when the heel of the boot to be removed is positioned within the boot heel opening so that primarily the larger muscles of the active leg may be used to remove the boot.

18. The boot jack of claim 17 wherein the upper section further includes a boot toe engaging member having a surface positioned above the boot heel engaging edges for restraining the boot toe from upward movement, the boot toe engaging member joining the surfaces forming the boot heel opening to provide a generally elliptically shaped opening through which the boot to be removed may be inserted.

19. The boot jack of claim 18 wherein the first acute angle is within the range of about 30° to 80°.

20. The boot jack of claim 19 wherein the step tread surface is a composite surface with the heel accommodating areas lying in a plane substantially parallel to the level surface and the ball of the feet accommodating areas lying in a second plane which intersects the first plane at a second acute angle and extends upwardly therefrom so that the ball of the active foot is positioned above the heel thereof.

21. The boot jack of claim 20 wherein each boot heel engaging edge includes a proximal section extending forwardly of the rear portion of the base and a distal section extending forwardly of the proximal section and inclined downwardly toward the level surface.

22. The boot jack of claim 21 further including a rib extending upwardly from the step tread surface adjacent the edge of each heel rest area.

23. A boot jack in which an active leg of the user may be used to force the boot off of the other or inactive leg comprising:

a base having front and rear portions and adapted to rest on a level surface;

an upper section formed integrally with the base and having a step tread surface on the top thereof arranged about a longitudinal axis, the step tread surface defining left and right foot rest areas for accommodating the heel and ball of the foot of the inactive leg, the foot rest areas being symmetrically about the longitudinal axis so that a line drawn from the heel to the ball of the foot of each area intersects a vertical plane passing through the longitudinal axis at a first acute angle within the range of about 30° to 80°;

the foot rest areas being formed in intersecting planes with the heel accommodating areas being formed in a first plane positioned generally parallel to the level surface and the ball of the foot accommodating areas being formed in a second plane which extends generally upwardly from the first plane;

the upper section further having a generally V-shaped opening therein symmetrically arranged about the longitudinal axis for receiving the heel of the boot to be removed, the boot heel opening being formed by a pair of opposed downwardly extending surface terminating in a pair of boot heel engaging edges;

the boot heel engaging edges extending above the level surface a sufficient distance to accommodate the heel of a boot and extending below the step tread surface about two inches so that the knee of the active leg must be bent when the heel of the boot to be removed is positioned within the boot heel opening; and the upper section further defining a boot toe engaging surface positioned above the boot heel engaging edges for restraining the boot toe from upward movement.

24. The boot jack of claim 1 wherein the boot heel engaging means comprises a pair of boot heel engaging surfaces extending below the step tread surface at least about two inches.

* * * * *